United States Patent [19]

Dailey

[11] 4,214,739

[45] Jul. 29, 1980

[54] FLY TYING DEVICE

[76] Inventor: Gregory M. Dailey, 404 S. Governor St., Iowa City, Iowa 52240

[21] Appl. No.: 947,051

[22] Filed: Sep. 29, 1978

[51] Int. Cl.[2] ..... B25B 1/22

[52] U.S. Cl. ..... 269/75

[58] Field of Search ..... 269/45, 71, 75, 97; 248/159

[56] References Cited

U.S. PATENT DOCUMENTS

| | | | |
|---|---|---|---|
| 49,145 | 8/1865 | Palmenberg | 248/159 |
| 688,230 | 12/1901 | Isgrid et al. | 269/45 |
| 2,673,054 | 3/1954 | Slavik | 269/75 |
| 2,898,068 | 8/1959 | Warren | 269/75 |
| 3,661,376 | 5/1972 | Hill et al. | 269/75 |
| 4,039,178 | 8/1977 | Odames | 269/75 |
| 4,070,011 | 1/1978 | Glesser | 269/75 |

*Primary Examiner*—Robert C. Watson

*Attorney, Agent, or Firm*—Sixbey, Friedman & Leedom

[57] ABSTRACT

An improved device for use in tying feathers, hair, synthetics and other fly dressing materials onto a fish hook used in sport fishing involving a clamp base member securing a rotatable support member with an extensible, multi-positionable shaft extending therefrom and, in turn, supporting a selectively positionable jaw clamp to hold the hook in any position desired during the fly tying operation.

12 Claims, 1 Drawing Figure

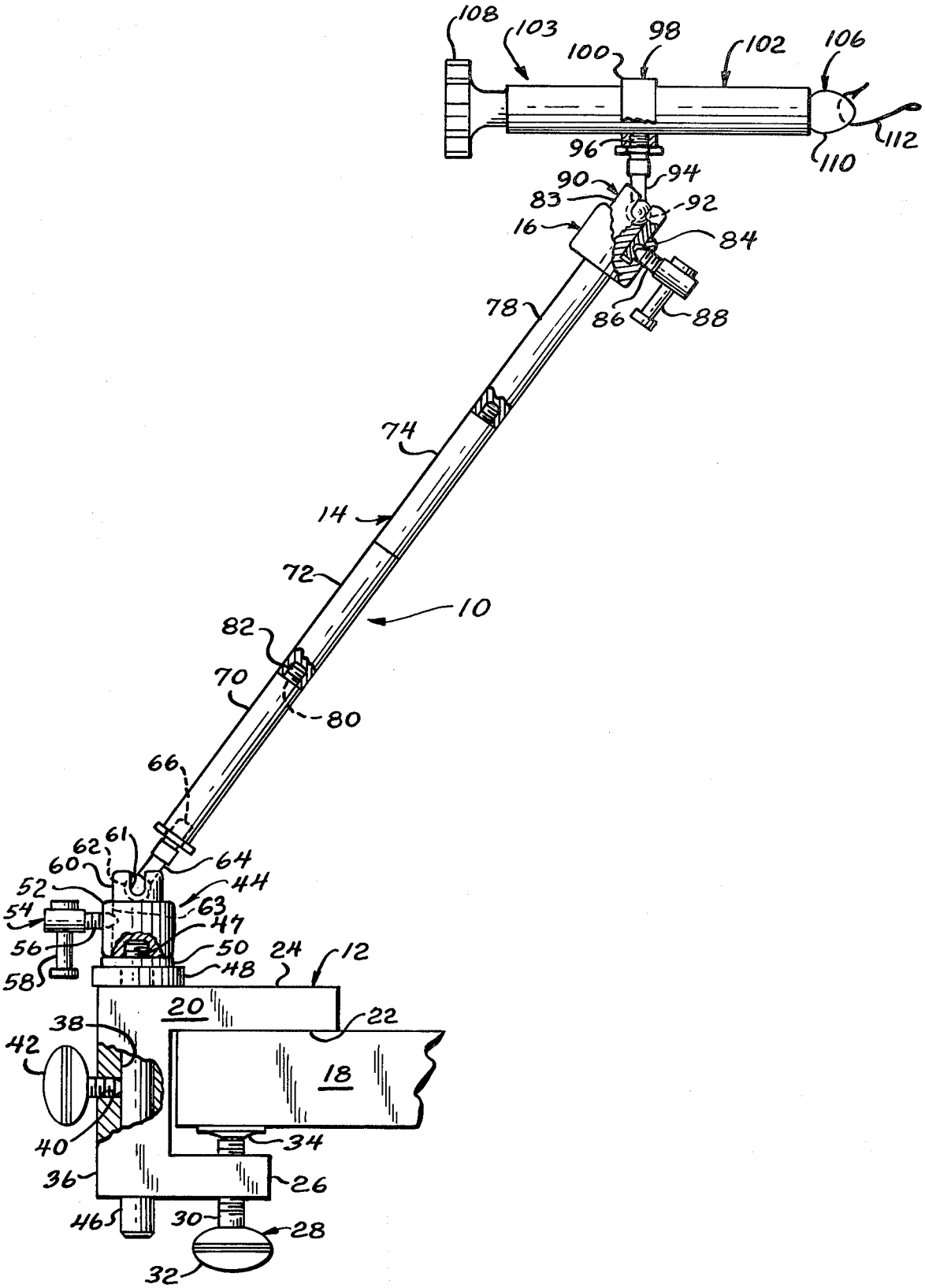
108
103
98
100
102
106
112
110
96
94
90
83
92
16
84
78
86
88
74
14
72
10
82
70
80
66
62
61
60
64
52
44
54
63
47
56
50
24
12
58
48
20
22
38
42
18
40
34
36
26
46
30
28
32

FLY TYING DEVICE

BACKGROUND OF THE INVENTION

Many different devices have been developed from time-to-time for use in tying feathers, hair, synthetics and other fly dressing materials, otherwise hereinafter referred to as fly dressing materials, to a fish hook. However, they possess inherent limitations which make them awkward to use or which define limited use characteristics.

One of the more important aspects of devices of this type resided in complete position flexibility. Another lies in adaptability for use in varying circumstances. Prior art devices have generally not satisfied these requirements and, thus, have been limited in use.

The present invention is directed to the provision of an improved device for use in the tying of fly dressing materials to a fish hook and more particularly to the provision of a totally flexibly positionable device for use under all circumstances and conditions of use that are currently recognized, and for use under additional circumstances and conditions utilizable by my design alone in the difficult art.

Limitations of prior art devices have been overcome in the provision of the device disclosed and claimed herein in that the device is capable of being used in substantially any circumstance of use be it for mounting on a drawer upright, tent pole, car window, table, shelf, desk top, projection, or any clampable surface, or the like. Similarly, the hook clamp portion of the device, through the unique combination of elements associated therewith, may be oriented in any desired position for use in tying of fly dressing materials on the hook held thereby and may temporarily be moved to different orientations providing increased convenience not obtainable by devices known in the art and providing greater ease and comfort for the tyer during the process of dressing flies thereby eliminating fatigue resulting from a fixed constant device.

It is, therefore, a primary object of the present invention to provide an improved device for use in tying fly dressing materials onto fish hooks and more particularly in the provision of a multi-positionable clamp means associated with the apparatus which may be moved form position to position, as desired by the user, without affecting stability of the selected position of use.

Other objects and advantages of the present invention reside in the provision of an improved device for use in tying fly dressing materials onto fish hooks which is easier to use and adapted for varying conditions of use unobtainable by prior art devices, which is economical to manufacture and use and which is durable in use.

The novel features which I believe to be characteristic of my invention are set forth with particularity in the appended claims. My invention itself, however, together with further objects and advantages thereof will best be understood by reference to the following description taken in connection with the accompanying drawing, in which:

FIG. 1 is a side elevation of the apparatus of the present invention showing the multi-positionable hook clamp means and associated apparatus.

Referring more particularly now to the drawing of FIG. 1 the device is indicated generally at 10 and includes a support clamp structure indicated generally at

12, a shaft support clamp 44, an extensible shaft member 14 and a second clamp means indicated generally at 16.

The first support clamp member 12 is adapted to be secured to any clampable projection, as noted before, such as a bench or table top 18.

The clamp member 12 is defined by a generally C-shaped member 20 having a gripping face 22 on one arm 24 of the C-shaped member and a threaded opening (not shown) in the opposed arm 26 thereof. A threaded clamp element 28 has a threaded shank 30, gripping projection 32 for use in turning the threaded clamp element 28 and a gripping projection 34 associated therewith. It can readily be seen that the support clamp member 12 may be secured to any surface, as noted before, such as a bench top, for example, by placing the gripping face 22 on one side thereof and threadably moving the clamp element 28 within the threaded opening of the opposing arm of the C-shaped clamp member until the gripping position with respect to said clampable surface thereby rigidly securing the C-shaped clamp member 12 with respect to the surface.

The C-shaped clamp member 12 is provided with an interconnecting bridge element 36 extending between and joining the arm 24 and the opposed arm 26 thereby defining a rigid unit assembly.

The bridge element 36 is provided with a central opening 38 extending therethrough and a threaded opening 40 extending from the surface of the bridge element 36 inwardly to terminate at the central opening 38 with the general axis of the threaded opening 40 being normal to the longitudinal axis of the central opening 38 of the bridge section 36 of the C-shaped clamp member.

A threaded bolt 42 is adapted to be threadably received within the threaded opening 40 of the bridge element 36, as schematically illustrated in FIG. 1 of the drawings.

The support clamp 12 is further defined by a shaft support indicated generally at 44 and including a mounting post 46 which is adapted to be pivotally positioned within the central opening 38 of the bridge 36, as shown. The mounting post 46 extends into the opening 38 and may, in the preferred embodiment shown, extend entirely through the bridge section 36. The mounting post 46 is provided with a threaded projection 47 at its upper terminal for the purpose of threadably mounting the shaft clamp 44 as described hereinafter. It can readily be seen that the device is totally adapted for use in any mounted position of the clamp assembly by pivotal adjustment of the shaft clamp 44 mounted on the post 46 and by the pivotal adjustment of the mounting post 46 within central opening 38. This is accomplished by release of the shaft locking screw 42 and rotation of the entire assembly within the clamp 12. This positional action in combination with the positions obtainable by movement of the shaft and ball socket assemblies results in complete flexibility for movement of the hook clamp as described hereinafter.

A platform 48 is mounted on the mounting post 46 near the upper terminal thereof and preferably is provided with a flat upper surface to frictionally engage a washer element 50, of rubber synthetic, or any other material having suitable resilent characteristics in the completed assembly, as noted hereinbelow. The platform 48 permits action and use of the present assembly in combination with any clamping means 12 selected for use. That is a curved clamping means 12 will not limit use of the device.

A shaft support member 52 is threadably mounted at the upper threaded terminal of the mounting post 46 and is adapted to be rotated with respect to the post 46 and by pivotal adjustment of the mounting post 46 within central opening 38 as desired by the user of the apparatus. Threaded locking means 54 are provided with the shaft support member 52. It can readily be seen that the threaded shaft member 56 of the locking means 54 is adapted to be threadably received with a mating threaded opening (not shown) extending through the wall of the shaft support member and to engage the ball support 63 when threadably rotated into said opening to lock the ball 62 with respect to the support member 52 as desired by the user.

The shaft locking means 54 is further provided with a handle element 58 to provide means to grasp the locking means 54 for the purpose of rotating the threaded shaft member 56 inwardly or outwardly with respect to the threaded opening in the wall of the support member 52 thereby providing means to bring the inner terminal of the threaded shaft member 56 into or out of engagement with the ball support 63 to lock or release, respectively, the ball member 62 with respect to the shaft support 52.

A ball socket projection 60, which is rotatably mounted with respect to the upper terminal of the ball support section 52 of the apparatus is adapted to receive the ball defining the lower rotatable support for the shaft (described hereinbelow). A stub shaft 64 is secured at one end thereof to the ball 62 and terminates at the other end in a threaded projection 66.

Shaft segments 70, 72, 74, and 78 define the shaft 14 of the assembly. The shaft segments are generally elongated in form and may be tubular, hexagonal, or any other shape desired by the user of the apparatus—the externally defined shape of the shaft segments not being critical to the function of the apparatus defined herein.

The shaft segments are provided with a threaded opening 80 extending inwardly along the generally longitudinal axis of the segments at one end thereof and with a threaded projection 82 along said general longitudinal axis at the other end thereof. The shaft segments may thereby be threadably joined together to define any desired shaft length by a combination of such segments in the assmebly. In the embodiment set forth herein four shaft segments are employed in the structure.

The ball 62 is rotatable within the ball socket 60 of the device so that the shaft 14 may be moved to any desired position by movement of the ball within the ball support 63. Additional flexibility of movement may be provided by defining recesses 61 in the socket 60 which extend downwardly from the top terminal thereof resulting in a plurality of spaced-apart finger elements to define the ball socket and defining a structure where the stub shaft 64 may be moved downwardly into the recesses 61 for greater positioning flexibility of the shaft 14.

A second clamp member 16 is received over the upper terminal of the shaft 14 and is secured thereon by any suitable means such as threading, soldering, or other securing methods. A threaded shaft member 86 is threadably received within a threaded opening 87 extending through the wall of the clamp member 16 so that the shaft 86 may be move into or out of locking engagement with the ball support 83 to lock or release the ball 92 with respect to the ball support 83. A shaft handle 88 is provided for convenience of the user in grasping the shaft 86 for movement as noted.

A ball socket 90, rotatable with respect to the ball support section 84, is provided at the upper terminal of the second clamp 16 and is adapted to moveably engage the ball 92 associated with the apparatus. A stub shaft 94 extends from the ball 92 and terminates in a threaded projection 96.

The jaw clamp 98 is threadably mounted on the second clamp member 16 by the clamp ring 100 which, in turn, secures the collar 102 in the apparatus.

The collar 102 is defined by the element into which the clamping means 106 is received. It should be noted that the collar 102 and jaws 110 are rotatably mounted within the clamp ring 100 so that the hook 112 mounted therein may be rotated to any desired position and be securely positioned in any selected orientation. The clamping means 106 includes adjustable clamp means so that when the adjusting member 108 is rotated within the collar 102 a pair of opposed jaws 110, which are biased away from each other, are adapted to be moved toward or away from each other to grip or release a fish hook 112 interposed therebetween. It can readily be seen that rotation of the clamp adjusting means 108 in one direction will bring the jaws 110 together and will rigidly capture the fish hook 112 interposed between the jaws 110 of the apparatus 103. Rotation of the adjusting means in the opposite direction will cause the jaws 110 to extend outwardly of the collar 102 where the bias will cause them to move apart to release the fish hook.

The ball socket 90 may be defined by the spaced apart finger-like ball joint structure described in connection with the ball socket 60 above and thereby provide for greater flexibility of movement of the ball and stub shaft within the socket for greater freedom in positioning of the collar 102.

The shaft segments 70, 72, 74 and 78 may be provided with knurled segments about the outer periphery thereof to facilitate grasping in manipulation of the shaft segments by the user.

It should be noted that the assembly disclosed and claimed herein provides a further important desirable feature of being moveable to various positions in use without disturbing rigidity of assembly. This functional characteristic is provided by inclusion of the resilient washer member 50 associated with the apparatus. The shaft clamp member 44 is threadably mounted on the threaded projection 47 which extends through washer member 50 such that the shaft support 52 is brought into close engagement with the flexible washer element 50 to capture the washer between the shaft support 52 and the platform 48 associated with the apparatus. It should be noted that if the upper surface of the clamp 12 is flat, then the platform 48 may not be required. The capture is of such character that the shaft support member 52 may be rotated with respect to the clamp 12 to a position where the support 52 moves threadably on the projection 47 to release the clamping engagement of the washer 50 between the support 52 and platform 48 to temporarily orient the shaft assembly as desired. When the assembly 52 is to be restored to the original use position it is simply rotated in the reverse direction and the movement of the member 52 on the threaded projection 47 will again securely clamp the support member 52 with respect to the clamp 12 by rigid capture of the washer 50 between the platform 48 and the support 52 to define rigidity of the use position.

It can readily be seen that the rigidly secured use position is redefined after a period of temporary interruption of use by simply restoring the shaft assembly to its use position whereby automatically securing the assembly in the use position.

While I have shown and described a specific embodiment of the present invention it will, of course, be understood that other modifications and alternative constructions may be used without departing from the true spirit and scope of this invention. I therefore intend by the appended claims to cover all such modifications and alternative constructions as fall within their true spirit and scope.

I claim:

1. A fly tying device for securing a fishing hook during fly tying operations, said device including a collet and jaw mechanism adapted to hold said fishing hook, a shaft member, a clamp member adapted to clamp onto a surface, a first connecting means for connecting said collect and jaw mechanism to the upper terminus of said shaft member and operating to allow said collet and jaw mechanism to pivot in a completely universal manner about said upper terminus, said first connecting means including a first ball joint assembly including a first ball member having a first joint segment which projects from the outer surface thereof, bracket means connected to said first joint segment and to said collet and jaw mechanism, a first socket means for pivotally receiving said first ball member, said first socket means having recesses which extend downwardly from the top thereof for a predetermined distance, said recesses being formed to receive said first joint segment, a first housing structure affixed to said upper terminus of said shaft member, said first socket means being supported by said first housing structure for rotation relative thereto, and a first locking means attached to said first housing structure, said first locking means operating to selectively lock said first ball member against movement within said first socket means, and a second connecting means for connectthe lower terminus of said shaft member to said clamp member, said second connecting means operating to allow said shaft member to pivot in a hemispherical manner about said lower terminus, said first and second connecting means cooperating to facilitate movement of said collet and jaw mechanism to a wide variety of positions to provide increased convenience, greater ease, and comfort for the fly tyer during the fly tying operation.

2. The fly tying device as described in claim 1 wherein said second connecting means includes a second ball joint assembly including a second ball member having a second joint segment which projects from the outer surface thereof, said second joint segment being connected to the lower terminus of said shaft member, a second socket means for pivotally receiving said second ball member, said second socket means having recesses which extend downwardly from the top thereof for a predetermined distance, said recesses being formed to receive said second joint segment, a second housing structure affixed to said clamp member, said second socket means being supported by said second housing structure for rotation relative thereto, and a second locking means attached to said second housing structure, said second locking means operating to selectively lock said second ball member against movement within said second socket means.

3. The fly tying device of claim 1 wherein said collet and jaw mechanism includes an elongated body, movable hook retaining jaw means extending from one end of said elongated body, and jaw operating means mounted on said elongated body for controlling movement of said hook retaining jaw means, said bracket means being connected to said elongated body between the ends thereof, said first joint segment being connected to said bracket means at one end and extending substantially normal to the longitudinal axis of said elongated body.

4. A fly tying device for securing a fishing hook during fly tying operations, said device including hook clamping means for securely clamping a hook, said hook clamping means including an elongated body, movable hook retaining jaw means extending from one end of said elongated body, said hook retaining jaw means being adapted to receive and clamp a hook, and jaw operating means mounted on said elongated body for controlling movement of said hook retaining jaw means, a shaft member, first connecting means for connecting said hook clamping means to the upper terminus of said shaft member, said first connecting means operating to permit said hook clamping means to pivot in a completely universal manner about said upper terminus, support means for said fly tying device, second connecting means for connecting the lower terminus of said shaft member to said support means, said second connecting means being mounted upon said support means and operating to permit the lower terminus of said shaft member to pivot in a hemispherical manner, and friction means provided between said support means and said second connecting means to frictionally oppose the rotation of said second connecting means relative to said support means.

5. The fly tying device of claim 4 wherein said second connecting means includes universal joint means connected to the lower terminus of said shaft member and operative to permit hemispherical movement of said shaft member, and locking means connected to said universal joint means and operative to lock said universal joint means against movement, said second connecting means being rotatable relative to said support means overriding the friction of said friction means when said universal joint means is locked by said locking means.

6. A fly tying device for securing a fishing hook during fly tying operations, said device including hook clamping means for securely clamping a hook, said hook clamping means including an elongated body, movable hook retaining jaw means extending from one end of said elongated body, said hook retaining jaw means being adapted to receive and clamp a hook, and jaw operating means mounted on said elongated body for controlling movement of said hook retaining jaw means, a shaft member, first connecting means for connecting said hook clamping means to the upper terminus of said shaft member and operating to permit said hook clamping means to pivot in a completely universal manner about said upper terminus and to permit the elongated body of said hook clamping means to be rotated about the longitudinal axis of said elongated body, said first connecting means including first universal joint means connected to the upper terminus of said shaft member, bracket means to support the elongated body of said hook clamping means at a position between the opposite ends thereof, said bracket means supporting said elongated body for rotation about the longitudinal axis thereof, and a first joint segment secured to said bracket means at one end and to said first universal joint means at the opposite end, said first joint segment extending substantially normal to the longitudinal axis of said elongated body, and second connecting means for connecting the lower terminus of said shaft member to a support means and operating to permit the lower terminus of said shaft member to pivot in a hemispherical manner, said second connecting means including second universal joint means connected to the lower terminus of said shaft member and operative to permit hemispherical movement of said shaft member, said second universal joint means being mounted upon said support means for rotation relative to said support means, and friction means provided between said second universal joint means and said support means to frictionally oppose the rotation of said second universal joint means relative to said support means.

7. The fly tying device of claim 6 wherein said first connecting means includes first locking means connected to said first universal joint means and operative to lock said first universal joint means against movement, and said second connecting means includes second locking means connected to said second universal joint means and operative to lock said second universal joint means against movement, said second connecting means being rotatable relative to said support means overriding the friction of said friction means when said second universal joint means is locked by said second locking means.

8. The fly tying device of claim 7 wherein said support means includes an elongated mounting post connected at one end to said second universal joint means, and a clamp member, said clamp member including a cavity to receive said mounting post.

9. The fly tying device of claim 8 wherein said support means includes a platform section attached to said mounting post and extending in a plane perpendicular to the longitudinal axis of said mounting post, said friction means being supported on said platform and contacting said platform and said second universal joint means, said clamp member having post locking means mounted thereon to lock said mounting post within said cavity.

10. The fly tying device of claim 9 wherein said first universal joint means includes a first ball member, said first joint segment projecting from the outer surface of said first ball member, a first socket means for pivotally receiving said first ball member, said first socket means having recesses which extend downwardly from the top thereof for a predetermined distance to receive said first joint segment and a first housing structure affixed to the upper terminus of said shaft member, said first socket means being supported by said first housing structure for rotation relative thereto.

11. The fly tying device of claim 10 wherein said second universal joint means includes a second ball member having a second joint segment projecting from the outer surface thereof, said second joint segment being connected to said shaft member and extending substantially parallel to the longitudinal axis of said shaft member, a second socket means for pivotally receiving said second ball member, said second socket means having recesses which extend downwardly from the top thereof for a predetermined distance to receive said second joint segment and a second housing structure affixed to the lower terminus of said shaft member, said second socket means being supported by said second housing structure for rotation relative thereto.

12. A fly tying device for securing a fishing hook during fly tying operations comprising hook clamping means for securely clamping a hook, said hook clamping means including an elongated body, movable hook retaining jaw means extending from one end of said elongated body, said hook retaining jaw means being adapted to receive and clamp a hook, and jaw operating means mounted on said elongated body for controlling movement of said hook retaining jaw means, a shaft member, first connecting means for connecting said hook clamping means to the upper terminus of said shaft member and operating to permit said hook clamping means to pivot in a completely universal manner about said upper terminus, said first connecting means including first universal joint means connected to the upper terminus of said shaft member, said first universal joint means including a first ball member having a first stub shaft which projects from the outer surface thereof, the end of said first stub shaft remote from said first ball member being connected to said elongated body and extending from said elongated body substantially perpendicular to the longitudinal axis thereof, and first socket means for pivotally receiving said first ball member, said first socket means having recesses which extend downwardly from the top thereof for a pedetermined distance to receive said first stub shaft and permit said elongated body to be moved to the side of said shaft member with the longitudinal axis thereof spaced from but extending in substantially the same direction as the longitudinal axis of said shaft member, and second connecting means for connecting the lower terminus of said shaft member to a support means, said second connecting means operating to permit the lower terminus of said shaft member to pivot in a hemispherical manner.

* * * * *